US012566013B2

(12) United States Patent
Li et al.

(10) Patent No.: US 12,566,013 B2
(45) Date of Patent: Mar. 3, 2026

(54) WATER-DISPENSING SYSTEM FOR GENERATING BOILED WATER OF DIFFERENT TEMPERATURES

(71) Applicant: ATLAN ELECTRICS APPLIANCE CO., LTD., Chongqing (CN)

(72) Inventors: Lian-Hong Li, Chongqing (CN); Xue Ma, Chongqing (CN); Xing-Fu Yang, Chongqing (CN)

(73) Assignee: Atlan Electrics Appliance Co., Ltd., Chongqing (CN)

( * ) Notice: Subject to any disclaimer, the term of this patent is extended or adjusted under 35 U.S.C. 154(b) by 166 days.

(21) Appl. No.: 18/667,135

(22) Filed: May 17, 2024

(65) Prior Publication Data

US 2025/0354721 A1 Nov. 20, 2025

(51) Int. Cl.

| | |
|---|---|
| ***F24H 15/174*** | (2022.01) |
| ***F24H 1/10*** | (2022.01) |
| ***F24H 1/52*** | (2022.01) |
| ***F24H 15/219*** | (2022.01) |
| ***F24H 15/305*** | (2022.01) |

(52) U.S. Cl.

CPC ..... *F24H 15/174* (2022.01); *F24H 1/10* (2013.01); *F24H 1/52* (2013.01); *F24H 15/219* (2022.01); *F24H 15/305* (2022.01)

(58) Field of Classification Search

CPC .... F24H 15/174; F24H 15/219; F24H 15/305; F24H 1/10

See application file for complete search history.

(56) References Cited

U.S. PATENT DOCUMENTS

2025/0011150 A1* 1/2025 Peteri ..... E03C 1/0411

FOREIGN PATENT DOCUMENTS

CN 115540337 A * 12/2022 ..... F24H 9/1818
CN 116499117 A * 7/2023 ..... F24H 1/10

* cited by examiner

*Primary Examiner* — Jennifer C Chiang

(74) *Attorney, Agent, or Firm* — Rosenberg, Klein & Lee

(57) ABSTRACT

A water-dispensing system includes an inlet channel for supplying unboiled water, a boiling area, a heat-exchange area, and a chilling area. The boiling area has a heater disposed on the inlet channel for boiling the unboiled water and connected to a hot-water channel. The hot-water channel is connected to a feeding channel. The heat-exchange area has a heat-exchange container where a heat-exchange pipe is sinuously arranged and then connected to the feeding channel and a warm-water channel. A cooling unit is outside the heat-exchange pipe. The chilling area has a refrigerant container where a chilling pipe is sinuously arranged and a chilling unit adapted to cool boiled water and the cooling material. The chilling pipe is connected to the warm-water channel and a cold-water channel. Accordingly, the system supplies boiled water having different temperatures and preheats the unboiled water to save boiling time and reduce energy consumption.

4 Claims, 2 Drawing Sheets

WATER-DISPENSING SYSTEM FOR GENERATING BOILED WATER OF DIFFERENT TEMPERATURES

BACKGROUND OF THE INVENTION

1. Field of the Invention

This invention relates to a water-dispensing device and relates particularly to a water-dispensing system for generating boiled water of different temperatures.

2. Description of the Related Art

An adequate intake of daily water is one of the main factors to maintain good health. Although tap water will be processed simply before being exported to taps of users, the tap water may be contaminated easily during the delivery in water distribution pipelines. Thus, it is not recommended to drink the tap water directly. In other words, the tap water should be boiled before drinking, thereby killing or inactivating germs. A water-dispensing device is usually adapted to supply boiled water because it is much more convenient than boiling the tap water on a fire. Hence, the water-dispensing device becomes one of the essential appliances in many households.

Referring to FIG. 1, a conventional water-dispensing device 1 comprises an inlet channel 11 connected to a water source (not shown) for introducing unboiled water from the water source, a heater 12 installed on the inlet channel 11, a hot-water container 13 connected to the heater 12, a first control valve 14 connected to the hot-water container 13, a warm-water container 15 connected to the hot-water container 13, and a second control valve 16 connected to the warm-water container 15. During a water-dispensing operation of the water-dispensing device 1, the unboiled water, namely the tap water, is imported into the inlet channel 11 from the water source and subjected to a boiling treatment conducted by the heater 12 whereby the unboiled water is turned into the hot boiled water. The hot boiled water is then exported and stored in the hot-water container 13. Some of the hot boiled water is introduced into the warm-water container 15 through the hot-water container 13 whereby the hot boiled water in the warm-water container 15 is cooled down gradually and tuned into warm boiled water. The first control valve 14 and the second control valve 16 are adapted to control the export of the hot boiled water and the warm boiled water, thereby meeting different drinking requirements.

The hot boiled water generated by the water-dispensing device 1 is usually stored in the hot-water container 13 after the unboiled water is turned into the hot boiled water caused by the boiling treatment so that the hot boiled water is exported quickly when it is needed. However, the hot boiled water in the hot-water container 13 is cooled down over time easily, and thus the temperature of the hot boiled water cannot be maintained at a high temperature of around 100° C. at any time. When the hot boiled water having the high temperature is needed, the hot boiled water in the hot-water container 13 should be subjected to the boiling treatment again. The re-boiling treatment consumes a lot of energy and time. In addition, the water-dispensing device 1 can only supply the hot boiled water and the warm boiled water. The water-dispensing device 1 also cannot control the temperature of the boiled water supplied accurately, and that is inconvenient for use. Further, the hot-water container 13 and the warm-water container 15 of the water-dispensing device 1 occupy a lot of space, and therefore the installation and the arrangement of the water-dispensing device 1 is restricted to the space, and that requires to be improved.

SUMMARY OF THE INVENTION

The object of this invention is to provide a water-dispensing system for generating boiled water of different temperatures capable of preheating unboiled water to shorten boiling time and reduce energy consumption, supplying boiled water having different temperatures quickly, and greatly improving the convenience of use.

The water-dispensing system for generating boiled water of different temperatures of this invention comprises an inflow area, a boiling area, a heat-exchange area, and a chilling area. The inflow area includes an inlet channel connected to a water source for importing unboiled water from the water source into the inlet channel. The boiling area includes a heater installed on the inlet channel, a hot-water channel connected to the heater and opposite to the inlet channel, a hot-water outlet formed at one end of the hot-water channel for exporting hot boiled water, a first control valve installed on the hot-water channel, and a feeding channel connected to the hot-water channel via the first control valve. The heat-exchange area includes a heat-exchange container in which a heat-exchange pipe is sinuously installed and a cooling unit outside the heat-exchange pipe. The heat-exchange pipe is connected between the feeding channel and a warm-water channel which has a warm-water outlet adapted to export warm boiled water. The cooling unit has a cooling material in the form of fluid filled in the heat-exchange container, and a first and a second delivery pipes extending outwards from the heat-exchange container respectively. The chilling area includes a refrigerant container in which a chilling pipe and a chilling unit are installed. The chilling pipe is connected between the warm-water channel and a cold-water channel which has a cold-water outlet adapted to export cold boiled water. The first and second delivery pipes are connected between the heat-exchange container and the refrigerant container, thereby allowing the heat-exchange container to export the cooling material through the first delivery pipe and to import the cooling material from the second delivery pipe to achieve the circulation of the cooling material between the heat-exchange container and the refrigerant container. A second control valve is installed between the refrigerant container and the warm-water channel for controlling the export of the warm boiled water into the chilling pipe inside the refrigerant container. Thus, the unboiled water is subjected to a boiling treatment executed by the heater whereby the unboiled water is turned into the hot boiled water when a hot-water mode is selected. The hot boiled water is then exported through the hot-water outlet. In a warm-water mode, the hot boiled water is introduced into the heat-exchange pipe through the feeding channel under the control of the first control valve and subjected to a heat-exchanging treatment whereby the hot boiled water is turned into the warm boiled water. The warm boiled water is exported through the warm-water outlet. Meanwhile, the subsequent unboiled water is also subjected to a heat-exchanging treatment while passing through the heat-exchange container whereby the unboiled water is preheated. Thus, the energy consumption and the required time for executing the boiling treatment are saved. Further, in a cold-water mode, the warm boiled water is introduced into the chilling pipe under the control of the second control valve and subjected to a chilling treatment conducted by the chilling unit whereby the warm boiled water is turned into the cold boiled water. The cold boiled water is exported through the cold-water outlet. Thus, the water-dispensing system is capable of supplying boiled water having different temperatures quickly to thereby meet different requirements and increase the convenience of use.

Preferably, at least one sensor is installed on the warm-water channel and adapted to detect a temperature of the warm boiled water in the warm-water channel.

Preferably, the chilling unit includes a compressor and a condensing pipe installed around the chilling pipe. The condensing pipe is f filled with a refrigerant material. The refrigerant material is driven by the compressor to flow within the condensing pipe.

Preferably, a returning channel is installed between the refrigerant container and the warm-water channel. The warm boiled water is cooled down by the chilling unit and turned into cool boiled water. The cool boiled water flows into the warm-water channel through the returning channel.

DETAILED DESCRIPTION OF THE PREFERRED EMBODIMENTS

Figure 1:
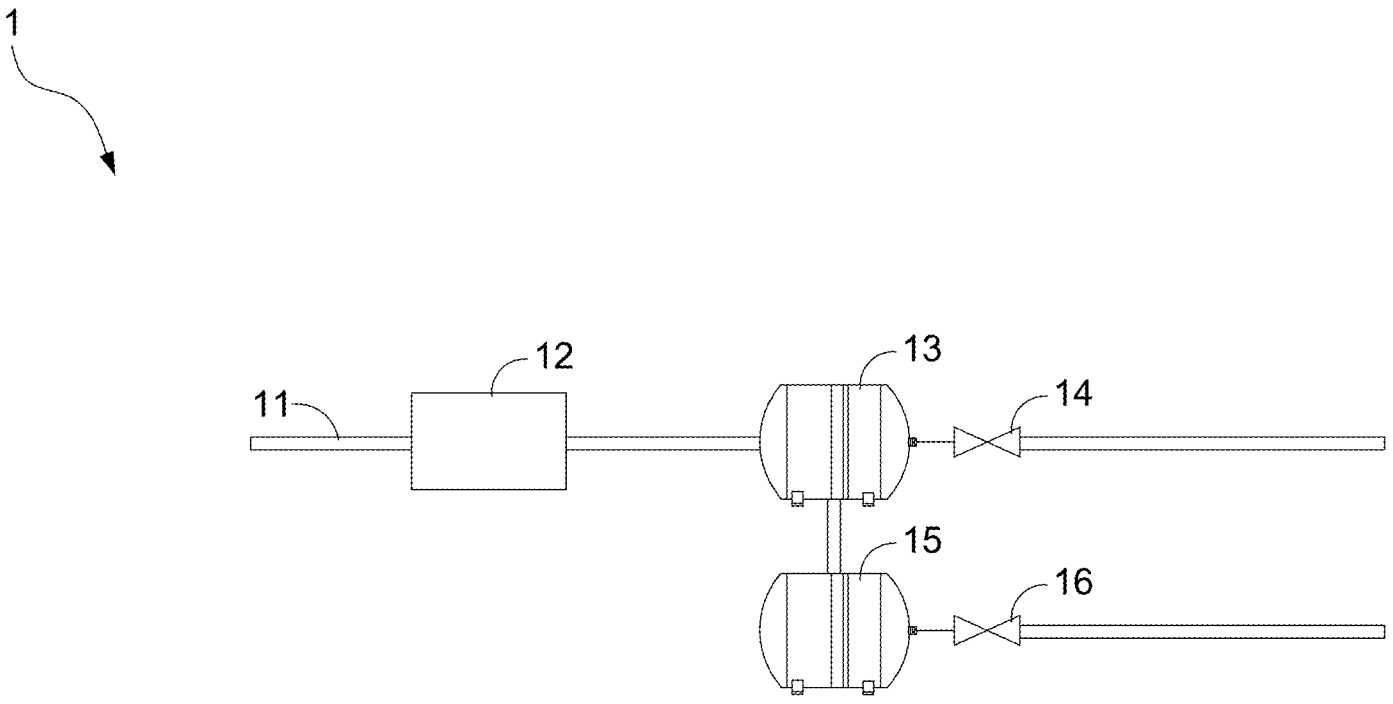
FIG .1 (PRIOR ART)
FIG. 1 is a schematic view showing a conventional water-dispensing device.
Figure 2:
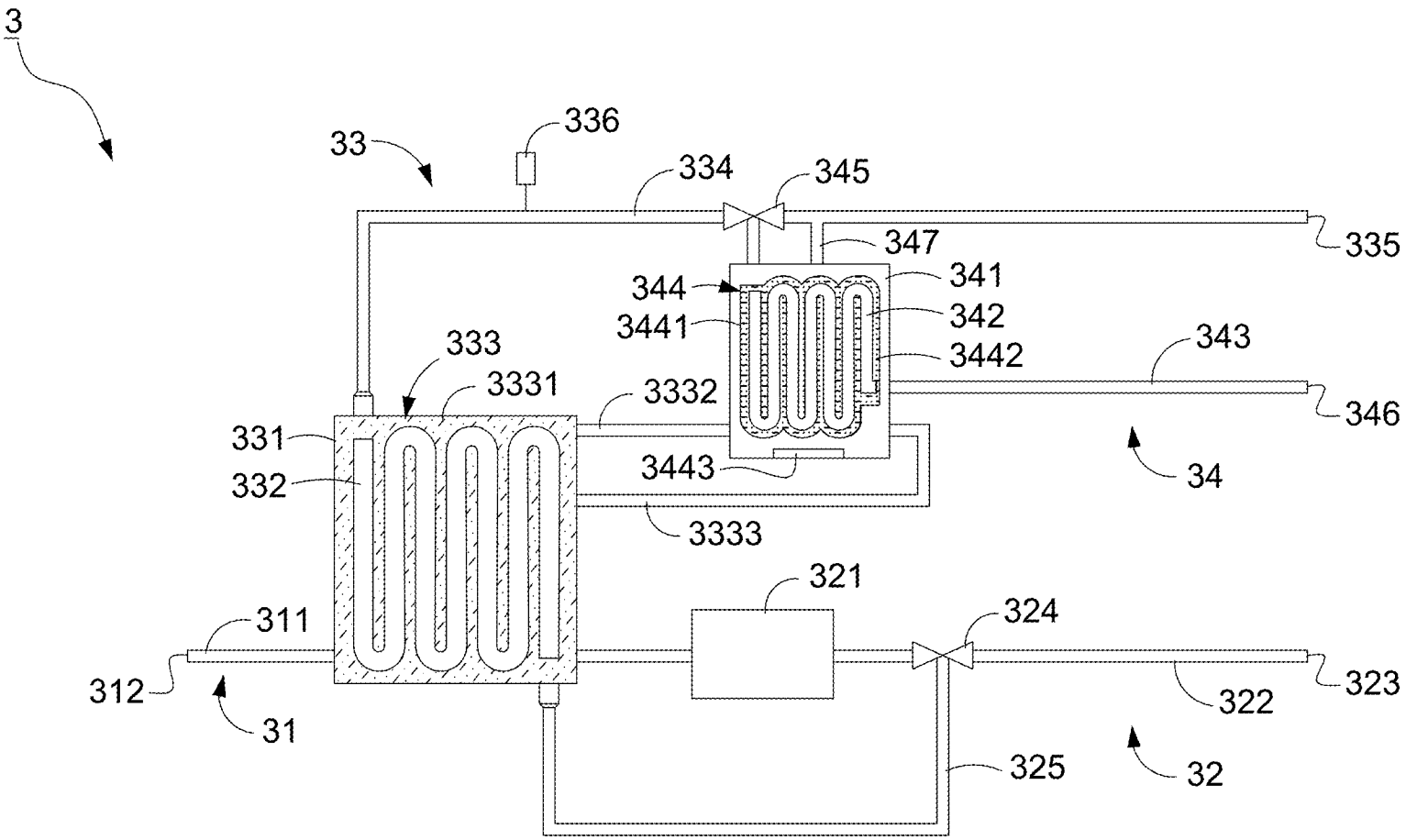
FIG. 2 is a schematic view showing a first preferred embodiment of this invention.

Referring to FIG. 2, a first preferred embodiment of a water-dispensing system 3 for generating boiled water of different temperatures of this invention is disclosed. The water-dispensing system 3 includes an inflow area 31, a boiling area 32 connected to the inflow area 31, a heat-exchange area 33 connected to the boiling area 32 and the inflow area 31 respectively, and a chilling area 34 connected to the heat-exchange area 33. The inflow area 31 has an inlet channel 311 and an unboiled water inlet 312 formed at one end of the inlet channel 311. The inlet channel 311 is connected to a water source (not shown) via the unboiled water inlet 312 for introducing unboiled water from the water source into the inlet channel 311.

The boiling area 32 has a heater 321 assembled on the inlet channel 311, a hot-water channel 322 extending outwards from the heater 321, a hot-water outlet 323 formed at one end of the hot-water channel 322, a first control valve 324 set on the hot-water channel 322, and a feeding channel 325 connected to the hot-water channel 322 via the first control valve 324. The unboiled water of the water source is imported into the inlet channel 311 and subjected to a boiling treatment conducted by the heater 321 whereby the unboiled water is turned into hot boiled water. The hot boiled water is introduced into the hot-water channel 322 and exported through the hot-water outlet 323. The hot boiled water is also allowed to be introduced into the heat-exchange area 33 through the feeding channel 325 under the control of the first control valve 324.

The heat-exchange area 33 has a heat-exchange container 331, a heat-exchange pipe 332 sinuously installed in the heat-exchange container 331 for receiving the hot boiled water, and a cooling unit 333 set outside the heat-exchange pipe 332. One end of the heat-exchange pipe 332 is connected to the feeding channel 325. Another end of the heat-exchange pipe 332 is connected to a warm-water channel 334. A warm-water outlet 335 is formed at one end of the warm-water channel 334. At least one sensor 336 is installed on the warm-water channel 334. The cooling unit 333 has a cooling material 3331 in the form of fluid accommodated in the heat-exchange container 331, a first delivery pipe 3332 and a second delivery pipe 3333 connected to the heat-exchange container 331 respectively whereby the heat-exchange container 331 can export the cooling material 3331 through the first delivery pipe 3332 and import the cooling material 3331 from the second delivery pipe 3333. The hot boiled water is introduced into the heat-exchange pipe 332 through the feeding channel 325 and then subjected to a heat-exchanging treatment conducted by the cooling material 3331 whereby the hot boiled water is cooled down and turned into warm boiled water. The warm boiled water is exported through the warm-water outlet 335 or is allowed to be introduced into the chilling area 34 through the warm-water channel 334. Meanwhile, the heat-exchange container 331 is connected to the inlet channel 311, namely the inlet channel 311 is inserted into the heat-exchange container 331, so that the unboiled water in the inlet channel 311 is also subjected to the heat-exchanging treatment conducted by the cooling material 3331 whereby the unboiled water is preheated.

The chilling area 34 has a refrigerant container 341, a chilling pipe 342 sinuously installed in the refrigerant container 341 for receiving the warm boiled water, a cold-water channel 343 extending outwards from the chilling pipe 342, a chilling unit 344 installed in the refrigerant container 341 for cooling the warm boiled water, a second control valve 345 set at a junction of the refrigerant container 341 and the warm-water channel 334, and a cold-water outlet 346 formed at one end of the cold-water channel 343. One end of the chilling pipe 342 is connected to the warm-water channel 334. Another end of the chilling pipe 342 is connected to the cold-water channel 343. In this preferred embodiment, the chilling unit 344 has a condensing pipe 3441 with which the chilling pipe 342 is covered, a refrigerant material 3442 filled in the condensing pipe 3441, and a compressor 3443. The refrigerant material 3442 is allowed to flow in the condensing pipe 3441 when the compressor 3443 is in operation. A returning channel 347 extends between the refrigerant container 341 and the warm-water channel 334. The warm boiled water in the warm-water channel 334 is introduced into the chilling pipe 342 under the control of the second control valve 345 and then subjected to a chilling treatment conducted by the chilling unit 344 whereby the warm boiled water is cooled down and turned into cold boiled water. The cold boiled water is exported through the cold-water outlet 346. Further, the first delivery pipe 3332 and the second delivery pipe 3333 are connected between the heat-exchange container 331 and the refrigerant container 341 whereby the cooling material 3331 is exported by the heat-exchange container 331 into the refrigerant container 341 through the first delivery pipe 3332 and cooled down by the chilling unit 344. The cooling material 3331 cooled down by the chilling unit 344 is allowed to be imported into the heat-exchange container 331 through the second delivery pipe 3333, thereby facilitating the circulation the cooling material 3331 between the refrigerant container 341 and the heat-exchange container 331 so that the temperature of the cooling material 3331 is controlled.

Referring to FIG. 2, during a water-dispensing operation of the water-dispensing system 3, when a hot-water mode is selected, the unboiled water is introduced into the inlet channel 311 from the water source via the unboiled water inlet 312. The unboiled water is then subjected to a boiling treatment executed by the heater 321 whereby the unboiled water is turned into the hot boiled water. The hot boiled water is exported through the hot-water outlet 323 along the hot-water channel 322, thereby supplying the hot boiled water having the high-temperature for use.

When a warm-water mode is selected, the hot boiled water is introduced into the heat-exchange pipe 332 through the feeding channel 325 under the control of the first control valve 324. Owing to the temperature differences between the hot boiled water and the cooling material 3331, the heat of the hot boiled water is transferred to the cooling material 3331 whereby the hot boiled water is cooled down and turned into the warm boiled water having the temperature around 45° C. The warm boiled water is exported through the warm-water outlet 335 along the warm-water channel 334. Meanwhile, the sensor 336 is adapted to detect the temperature of the warm boiled water so that the temperature of the warm boiled water conforms with a set temperature and is suitable for use. Because the inlet channel 311 is inserted into the heat-exchange container 331, the heat of the cooling material 3331 received from the hot boiled water is transferred to the unboiled water of the inlet channel 311 whereby the temperature of the cooling material 3331 is reduced and the temperature of the unboiled water is increased. Thus, the unboiled water in the inlet channel 311 is preheated before being boiled by the heater 321, thereby shortening the time required for boiling the unboiled water, reducing the energy consumed by the heater 321 for executing the boiling treatment, and accelerating the boiling treatment. In addition, the heat-exchanging circulation among the hot boiled water, the unboiled water, and the cooling material 3331 is capable of preventing energy waste.

When a cold-water mode is selected, the warm boiled water is introduced into the chilling pipe 342 under the control of the second control valve 345. Owing to the temperature differences between the warm boiled water and the refrigerant material 3442, the heat of the warm boiled water is transferred to the refrigerant material 3442 whereby the warm boiled water is cooled down and turned into the cold boiled water having the temperature below 45° C. The cold boiled water is exported through the cold-water outlet 346 along the cold-water channel 343, thereby supplying the cold boiled water having the low-temperature for use. Meanwhile, if the temperature of the warm boiled water detected by the sensor 336 does not meet the set temperature, namely the warm boiled water in the warm-water channel 334 is not cooled down to have a suitable temperature after the heat-exchanging treatment is conducted, the warm boiled water is introduced into the chilling pipe 342 for a shorter period whereby the warm boiled water is cooled down slightly and turned into cool boiled water having the temperature ranging between the temperature of the warm boiled water and the temperature of the cold boiled water. The cool boiled water is introduced into the warm-water channel 334 through the returning channel 347 and exported through the warm-water outlet 335. Hence, the water-dispensing system 3 is capable of supplying the boiled water having different temperatures quickly for meeting different purposes and satisfying different drinking habits and preferences, thereby improving the convenience of use. In addition, the boiled water having different temperatures is supplied after being subjected to the boiling treatment, thereby killing or inactivating germs, meeting the health and safety requirements, and ensuring the personal health. Further, when the temperature of the cooling material 3331 of the cooling unit 333 is too high, the cooling material 3331 is exported from the heat-exchange container 331 into the refrigerant container 341 through the first delivery pipe 3332 whereby the cooling material 3331 is cooled down by the chilling unit 344. The cooling material 3331 cooled down by the chilling unit 344 is then imported into the heat-exchange container 331 through the second delivery pipe 3333, thereby maintaining a stable operation of the cooling unit 333 and extending the service life of the cooling unit 333.

To sum up, the water-dispensing system for generating boiled water of different temperatures of this invention takes advantages that the unboiled water is subjected to the boiling treatment conducted by the heater whereby the unboiled water is turned into the hot boiled water in the hot-water mode. In the warm-water mode, the hot boiled water is subjected to the heat-exchanging treatment conducted by the cooling unit in the heat-exchange container after being introduced into the heat-exchange pipe whereby the hot boiled water is turned into the warm boiled water. The unboiled water in the inlet channel is also subjected to the heat-exchanging treatment so that the unboiled water is preheated, thereby effectively reducing the energy consumption and time required for boiling the unboiled water and increasing the boiling speed. In the cold-water mode, the warm boiled is subjected to the chilling treatment conducted by the chilling unit whereby the warm boiled water is turned into the cold boiled water after being introduced into the chilling pipe. Thus, the boiled water having different temperatures is provided speedily according to different requirements, thereby improving the convenience of use.

While the embodiments of this invention are shown and described, it is understood that further variations and modifications may be made without departing from the scope of this invention.

What is claimed is:

1. A water-dispensing system for generating boiled water of different temperatures comprising:

an inflow area including an inlet channel connected to a water source for introducing unboiled water from said water source into said inlet channel;

a boiling area including a heater disposed on said inlet channel, a hot-water channel extending outwards from said heater, a hot-water outlet formed at one end of said hot-water channel, a first control valve disposed on said hot-water channel, and a feeding channel connected to said hot-water channel via said first control valve, said unboiled water of said water source being introduced from said inlet channel into said hot-water channel and subjected to a boiling treatment conducted by said heater whereby said unboiled water is turned into hot boiled water, said hot boiled water being exported through said hot-water outlet;

a heat-exchange area including a heat-exchange container, a heat-exchange pipe sinuously disposed in said heat-exchange container for receiving said hot boiled water, and a cooling unit outside said heat-exchange pipe, wherein one end of said heat-exchange pipe is connected to said feeding channel, and another end of said heat-exchange pipe is connected to a warm-water channel, said cooling unit including a cooling material in the form of fluid accommodated in said heat-exchange container, said cooling material being adapted to subject said hot boiled water received by said heat-exchange pipe to a heat-exchanging treatment whereby said hot boiled water is turned into warm boiled water, said warm-water channel having a warm-water outlet adapted to export said warm boiled water, said cooling unit further including a first delivery pipe and a second delivery pipe extending outwards from said heat-exchange container respectively, thereby allowing said heat-exchange container to export said cooling material through said first delivery pipe and import said cooling material from said second delivery pipe; and a chilling area including a refrigerant container, a chilling pipe sinuously disposed in said refrigerant container and connected to said warm-water channel for receiving said warm boiled water, a cold-water channel extending outwards from said chilling pipe, a cold-water outlet formed at one end of said cold-water channel, and a chilling unit adapted to cool said warm boiled water within said refrigerant container, said refrigerant container being disposed between said first delivery pipe and said second delivery pipe, said refrigerant container thereby being adapted to receive said cooling material exported by said first delivery pipe and cool said cooling material down with said chilling unit, and said heat-exchange container being allowed to import said cooling material which is cooled down from said second delivery pipe, thereby facilitating the circulation of said cooling material between said refrigerant container and said heat-exchange container, a second control valve being disposed at a junction of said chilling pipe and said warm-water channel, said warm boiled water of said warm-water channel being allowed to flow into said chilling pipe inside said refrigerant container under the control of said second control valve, and said warm boiled water thereby being cooled down by said chilling unit and turned into cold boiled water, said cold boiled water being exported through said cold-water outlet.

2. The water-dispensing system according to claim 1, wherein at least one sensor is disposed on said warm-water channel and adapted to detect a temperature of said warm boiled water in said warm-water channel.

3. The water-dispensing system according to claim 1, wherein said chilling unit includes a compressor and a condensing pipe disposed around said chilling pipe, said condensing pipe being filled with a refrigerant material, said refrigerant material flowing in said condensing pipe when said compressor is in operation.

4. The water-dispensing system according to claim 1, wherein a returning channel is disposed between said refrigerant container and said warm-water channel, said warm boiled water being cooled down by said chilling unit and turned into cool boiled water, said cool boiled water flowing into said warm-water channel through said returning channel.

* * * * *